United States Patent [19]

Katoh et al.

[11] Patent Number: 4,959,687

[45] Date of Patent: Sep. 25, 1990

[54] BIAS POWER SOURCE CONTROLLER FOR AN IMAGE FORMING APPARATUS

[75] Inventors: Eiichi Katoh; Hitoshi Hoshi; Tsunehide Takahashi; Koichi Asakura, all of Tokyo, Japan

[73] Assignee: Ricoh Company, Ltd., Tokyo, Japan

[21] Appl. No.: 228,462

[22] Filed: Aug. 5, 1988

[30] Foreign Application Priority Data

Aug. 13, 1987 [JP] Japan ..... 62-200972

[51] Int. Cl.[5] ..... G03G 21/00

[52] U.S. Cl. ..... 355/214; 355/246

[58] Field of Search ..... 355/214, 245, 246

[56] References Cited

U.S. PATENT DOCUMENTS 4,256,401 3/1981 Fujimura et al. ..... 355/214

4,624,548 11/1986 Takayanagi ..... 355/214 X 4,640,603 2/1987 Honma ..... 355/214

*Primary Examiner*—Fred L. Braun

*Attorney, Agent, or Firm*—Oblon, Spivak, McClelland, Maier & Neustadt

[57] ABSTRACT

A controller for controlling a bias power source associated with, for example, a developing unit of an electrophotographic copier such that a bias voltage to be applied to the developing unit for the adjustment of image density is variable in level. The controller includes a central processing unit in which a timer/event counter is built in for delivering a trigger pulse signal to trigger the power source. In order to produce a bias voltage associated with a desired density level, the trigger pulse signal is subjected to pulse width modulation control at a period which is far shorter than an output time consant of the power source.

3 Claims, 8 Drawing Sheets

| | DENSITY SELECTED | BIAS VOLTAGE | TRIGGER DUTY | DATA |
|---|---|---|---|---|
| DARK ↑ | 1 | 100 V | 13 % | 108 |
| | 2 | 150 V | 21 % | 175 |
| | 3 | 200 V | 27 % | 225 |
| | 4 | 250 V | 34 % | 283 |
| LIGHT ↓ | 5 | 300 V | 41 % | 342 |
| | 6 | 350 V | 48 % | 400 |
| | 7 | 500 V | 67 % | 558 |

BIAS POWER SOURCE CONTROLLER FOR AN IMAGE FORMING APPARATUS

BACKGROUND OF THE INVENTION

The present invention relates to a device for controlling a power source of an electrophotographic copier, facsimile apparatus or similar image forming apparatus and, more particularly, to a controller for controlling a bias power source to vary a bias voltage to be applied from the power source to, for example, a developing roller of a developing unit in association with image density.

Two different methods are available with an image forming apparatus of the kind described for controlling a bias voltage, i.e., a method which sets a level of the bias voltage which is associated with one of a plurality of command signals each being representative of a different bias voltage level, and a method which increases the frequency of a trigger signal by a pulse width modulation (PWM) control to adjust a trigger ON time and a trigger OFF time and thereby varies the level of the bias voltage. A problem with the multiple command signal scheme is that level setting means for setting a bias voltage level is needed which results in a complicated and bulky construction. On the other hand, the PWM scheme brings about a problem that a trigger signal having such a high frequency keeps a central processing unit (CPU) of a control circuit busy and thereby imposes restriction on the controls available with the CPU. Another problem with the PWM scheme is that it needs a large-scale step-up transformer in a step-up circuit which constitutes the power source.

SUMMARY OF THE INVENTION

It is therefore an object of the present invention to eliminate the drawbacks particular to the prior art implementations as discussed above.

It is a specific object of the present invention to provide a bias power source controller for an image forming apparatus which with simple construction allows any number of bias voltages each having a desired level to be outputted stably.

It is another object of the present invention to provide a generally improved bias power source controller for an image forming apparatus.

A controller installed in an image forming apparatus for controlling a bias power source to vary a level of a bias voltage outputted by the bias power source in order to provide desired image density of the present invention comprises a density selecting circuit for selecting a desired image density, a trigger pulse signal generating circuit for generating a trigger pulse signal for triggering the bias power source so that the bias power source outputs a bias voltage of a level which is associated with the selected image density, and a control circuit for causing a pulse width of the trigger pulse signal to be varied in conformity to the selected image density.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to different examples of prior art bias power source controllers, shown in FIGS. 1 and 2.

Figure 1:
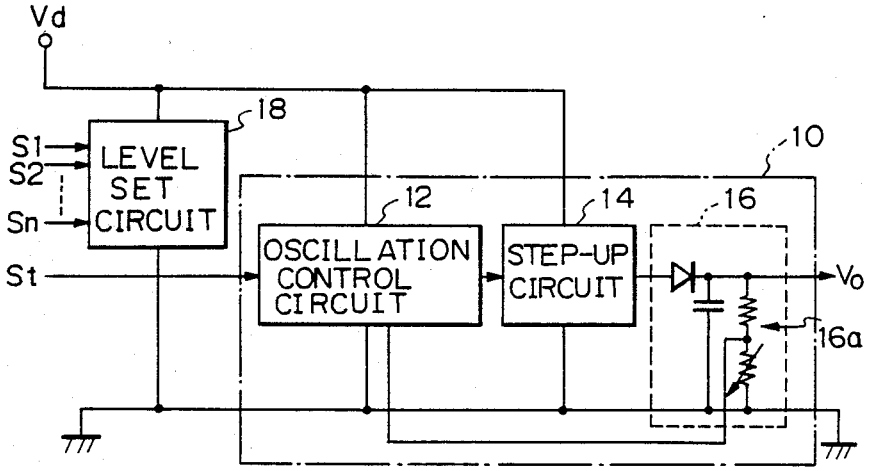
Fig. 1 PRIOR ART
FIGS. 1 and 2 are schematic block diagrams each showing a different prior art bias power source and a controller associated therewith.

A prior art control device shown in FIG. 1 is of the type varying a bias voltage from a bias power source in response to any of a plurality of command signals inputted. Specifically, a bias voltage power source 10 is constituted by an oscillation control circuit 12 to which a trigger signal $S_t$ is applied, a step-up circuit 14 implemented by a step-up transformer or the like, and a rectifying and smoothing circuit 16 which includes a level adjusting subsection **16*a*** and outputs a bias voltage $V_o$ having a desired level.

Connected to the bias power source 10 is a level setting circuit 18 which is adapted to set a level of the bias voltage $V_o$ to be outputted. A number of command signals $S_1$ to $S_n$ are applied to the level setting circuit 18 each indicating a particular level of the bias voltage $V_o$ to be outputted. Such a level setting circuit 18 is indispensable in the prior art control device, resulting in a complicated and bulky control circuit. In addition, a great number of bias voltage levels should be outputted in association with the command signals $S_1$ to $S_n$, rendering the control difficult.

Figure 2:
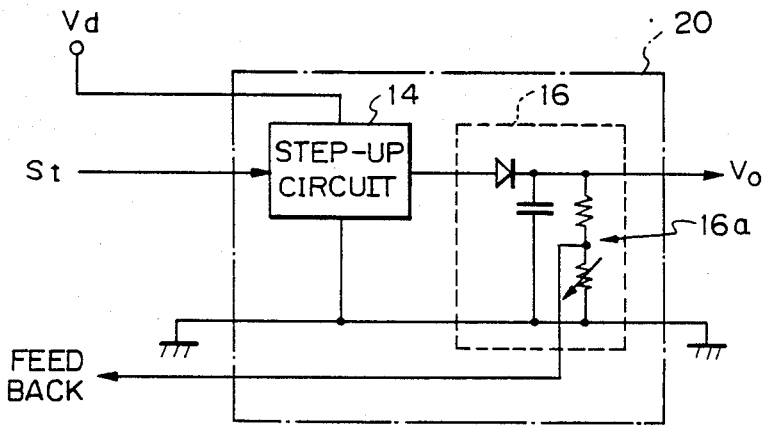
Fig. 2 PRIOR ART

Referring to FIG. 2, there is shown another prior art controller which performs a PWM control for increasing the frequency of the trigger signal $S_t$ and thereby adjusting a trigger ON time and a trigger OFF time so as to vary the level of the bias voltage $V_o$. Specifically, as shown in FIG. 2, a bias power source 20 is made up of a step-up circuit 14 and a rectifying and smoothing circuit 16 and lacks the oscillation control circuit 12 as shown in FIG. 1. The circuitry of FIG. 2 is advantageous over that of FIG. 1 in that the former is extremely simple in construction and its construction is not effected by the number of different output levels of the bias voltage $V_o$ at all. However, since the primary side of the step-up circuit 14 needs a predetermined impedance, it is necessary to increase the frequency of the trigger signal St to 20 to 30 kilohertz or to increase the number of turns of the step-up transformer of the step-up circuit 14. A problem with the first-mentioned scheme is that such a high frequency renders a CPU (not shown) busy and thereby imposes restriction on the controls available with the CPU. On the other hand, the second-mentioned scheme suffers from a drawback that the transformer and therefore the entire bias power source 20 becomes bulky, resulting in an increase in cost. Moreover, since the prior art controller of FIG. 2 lacks an oscillation control circuit, i.e., an integrated circuit for the bias power source, the bias voltage $V_o$ has to be fed back to the CPU in response to a change in input or in load by using disproportionately complicated control software.

Hereinafter will be described one embodiment of the bias power source controller in accordance with the present invention. In the illustrative embodiment, the same or similar structural elements as those of the prior art controllers are designated by like reference numerals.

Figure 3:
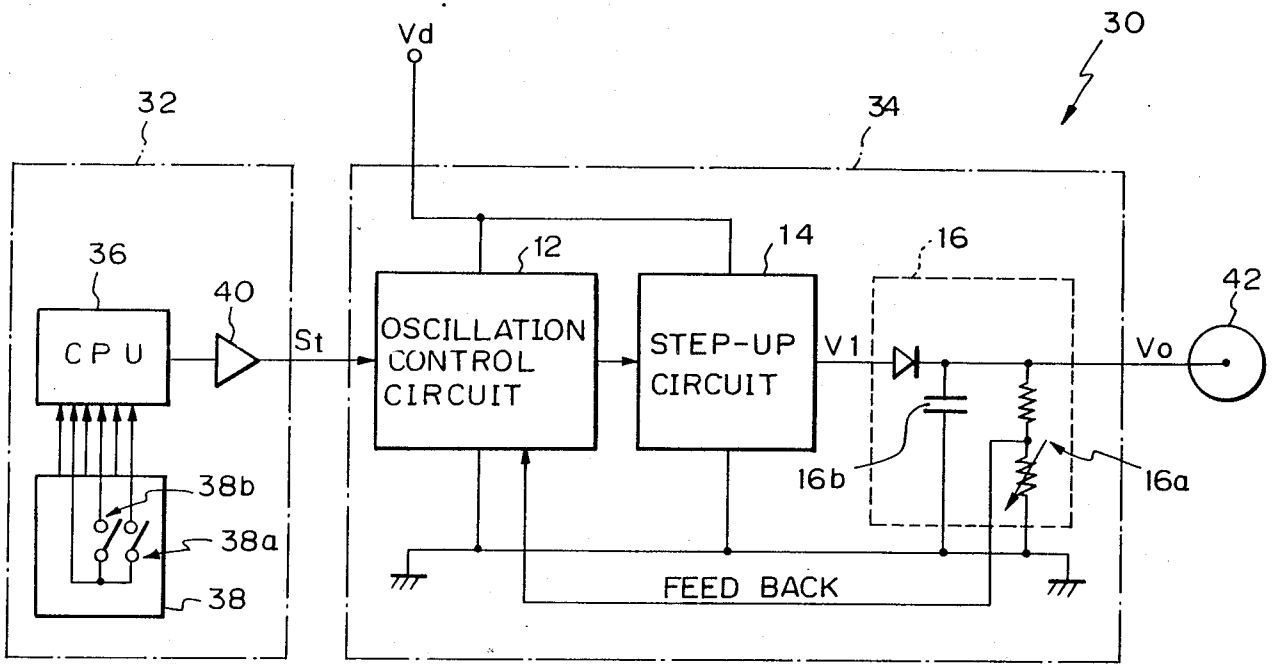
FIG. 3 is a schematic block diagram showing a bias power source and a controller associated therewith in accordance with the present invention.
Figure 4:
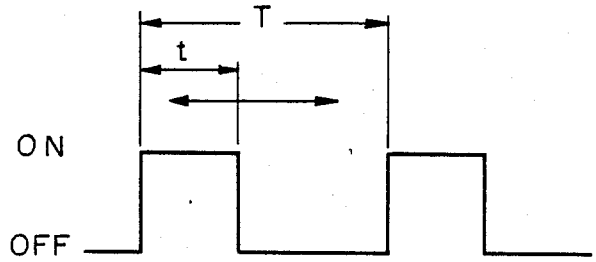
FIG. 4 is a diagram showing a period and a pulse width of a trigger signal which is outputted by a CPU of the controller as shown in FIG. 3.

Referring to FIG. 3, there is shown a system 30 which is made up of a controller 32 in accordance with the present invention and a bias power source 34 which is controlled by the controller 32. A bias power source 34, like the bias source of FIG. 1, comprises an oscillation control circuit 12, a step-up circuit 14, and a rectifying and smoothing circuit 16 which includes an output level adjusting subsection 16*a*. An operating section 38 includes switches 38*a* and 38*b* accessible for selecting comparatively high image density levels and comparatively low image density levels, respectively, the switches 38*a* and 38*b* being connected to a CPU 36. A trigger signal $S_t$ is applied to the power source 34 in the form of an output of a timer/event counter which is built in the CPU 36. More specifically, the operation mode of the timer/event counter is selected so that an output voltage associated with the density which is selected by the switch 38*a* or 38*b* may be produced. The trigger signal $S_t$ therefore has a predetermined period T and a pulse width t, as shown in FIG. 4. While the predetermined period T is selected to be 1 microsecond, the pulse width t is variable to vary the level of the bias voltage $V_o$ which is outputted by the power source 34. As shown in FIG. 3, the trigger signal $S_t$ fed to the power source 34 via a driver 40 is oscillated at a frequency of 20 to 30 kilohertz by the oscillation control circuit 12 and then stepped up by the step-up circuit 14 only when the trigger signal $St_t$ is ON becoming a stepped-up output $V_1$ of the step-up circuit 14. The rectifying and smoothing circuit 16 rectifies and smoothes the stepped-up voltage $V_1$ to produce a DC bias voltage $V_o$. This DC bias voltage $V_o$ is fed out to an image forming apparatus, e.g. a developing roller 42 of a developing unit which is included in an electrophotographic copier.

Figure 5:
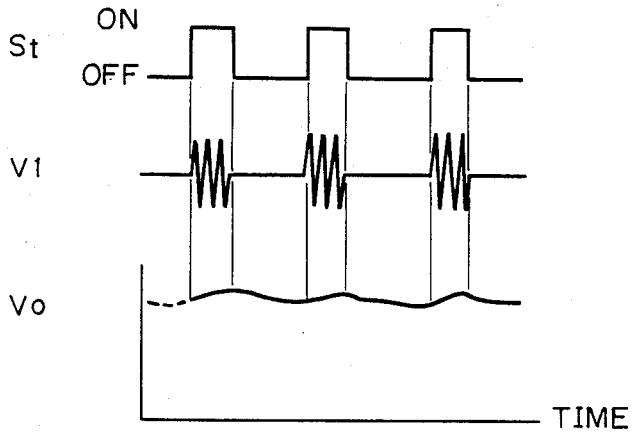
FIG. 5 is a diagram representative of a relationship between the trigger signal applied to the bias power source of FIG. 3 and an output bias voltage of the power source and an output signal of a step-up circuit which is included in the power source.

FIG. 5 shows the output signal $V_1$ of the step-up circuit 14 and the bias voltage $V_o$ outputted by the rectifying and smoothing circuit 16.

Figures 6, 7:
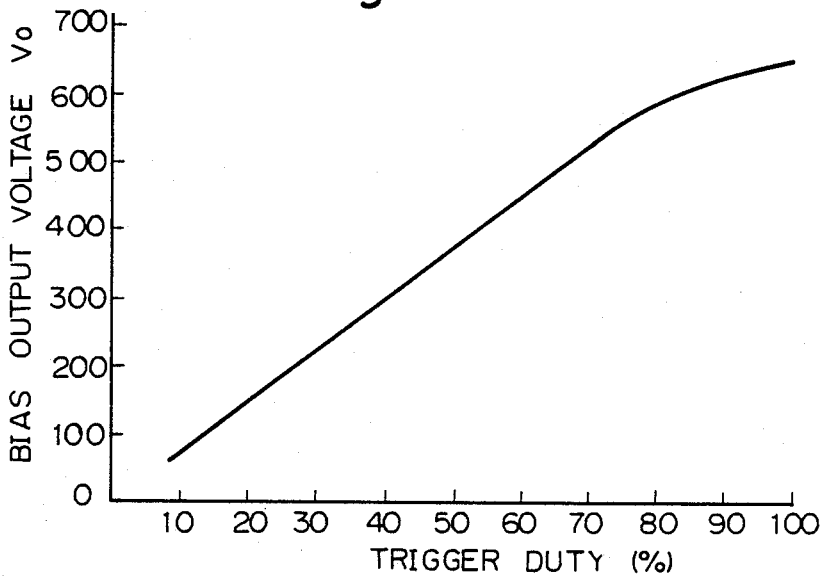
FIG. 6 is a plot showing a relationship between a trigger duty and a bias output voltage.
FIG. 7 is a table representative of a relationship between a bias voltage, a trigger duty, and data.

As shown in Fig. 6, the bias voltage $V_o$ becomes stable at a relatively low voltage of 650 volts for full trigger duty due to the repetition of charging and discharging which occur in a trigger ON condition and a trigger OFF condition, respectively. In FIG. 6, the abscissa and the ordinate indicate the trigger duty in terms of percentage and the bias voltage $V_o$, respectively. The discharging time constant $\tau$ of the bias voltage $V_o$ is determined by the insulation resistance of a bias electrode and the capacitance of a smoothing capacitor 16*b* which are approximately 10 megaohms and 220 OPF, respectively. Hence, $$\begin{aligned}\tau &= 10 \times 10^6 \times 2.2 \times 10^3 \times 10^{-12} \\ &= 2.2 \times 10^{-2} \\ &= 22 \text{ microseconds}\end{aligned}$$

Such a discharging time constant $\tau$ is sufficiently great compared to the period of the trigger signal which is 1 microsecond so that the ripples ascribable to the PWM control signal are almost negligible.

Figure 8:
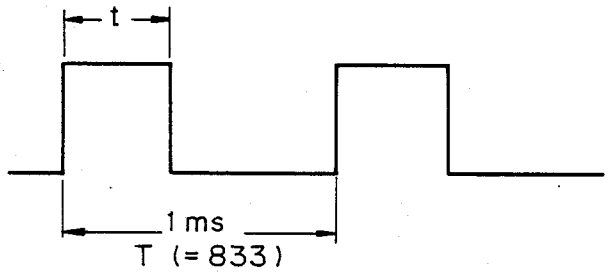
FIG. 8 is a diagram useful for understanding a step of a period T which is associated with one step of an event counter which is built in the CPU.

FIG. 7 lists different values of image density and bias voltages $V_o$, trigger duties and data t which are associated with the values of image density. Assuming that a clock of the CPU 36 has a frequency of 10 megahertz, one step of the event counter is 1.2 nanoseconds and 1 microsecond is 833 (see FIG. 8).

Figure 9:
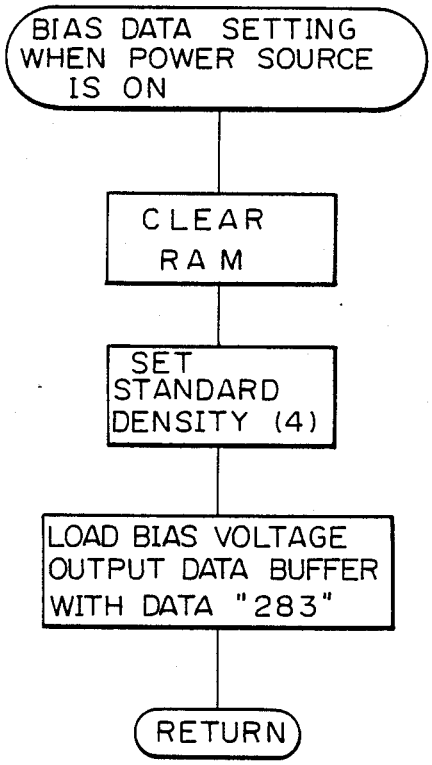
FIGS. 9, 10, 11 and 12 are flowcharts demonstrating control procedures in accordance with the present invention.

In FIG. 9, a procedure for setting bias data when a power switch is ON is shown. Data "283" representative of standard density "4" is loaded in an exclusive data buffer for bias voltage output.

Figure 10A:
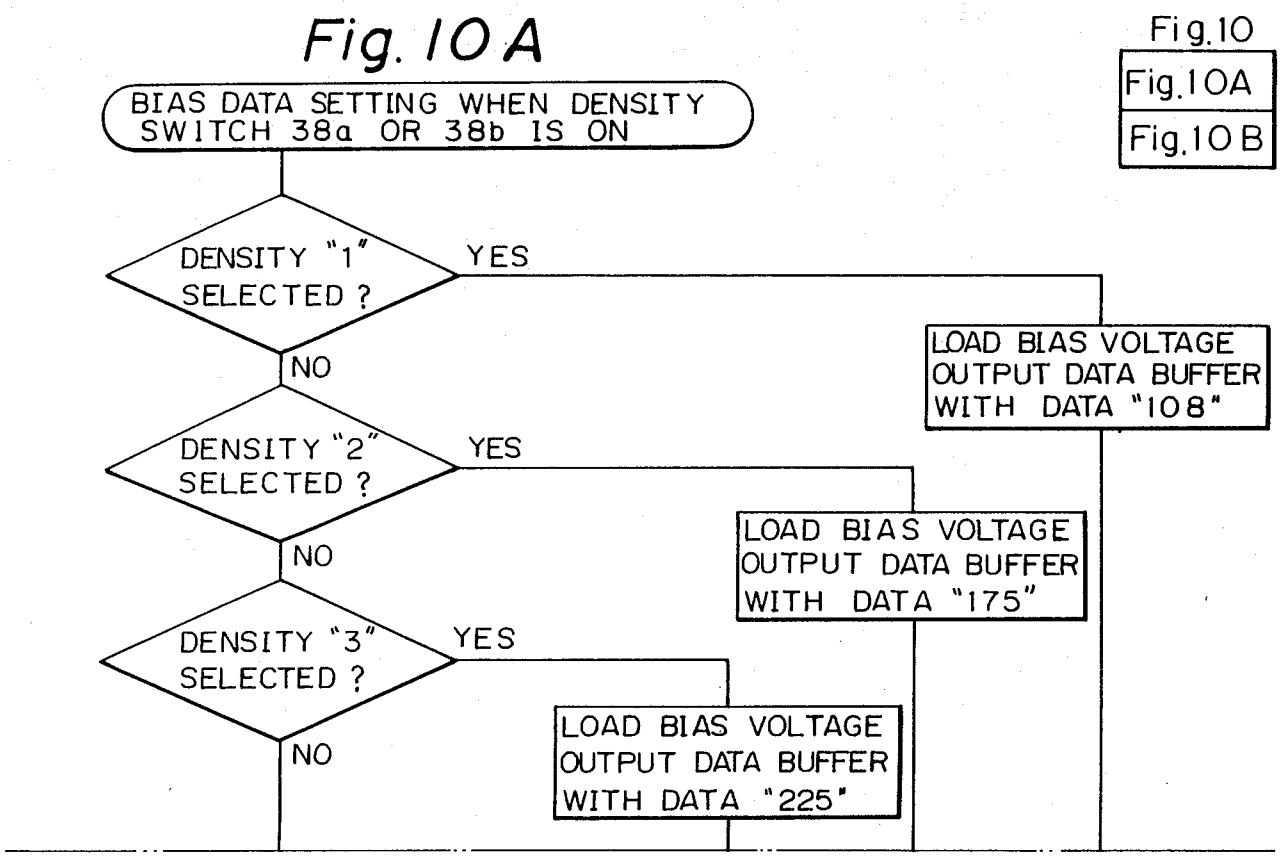
Figure 10B:
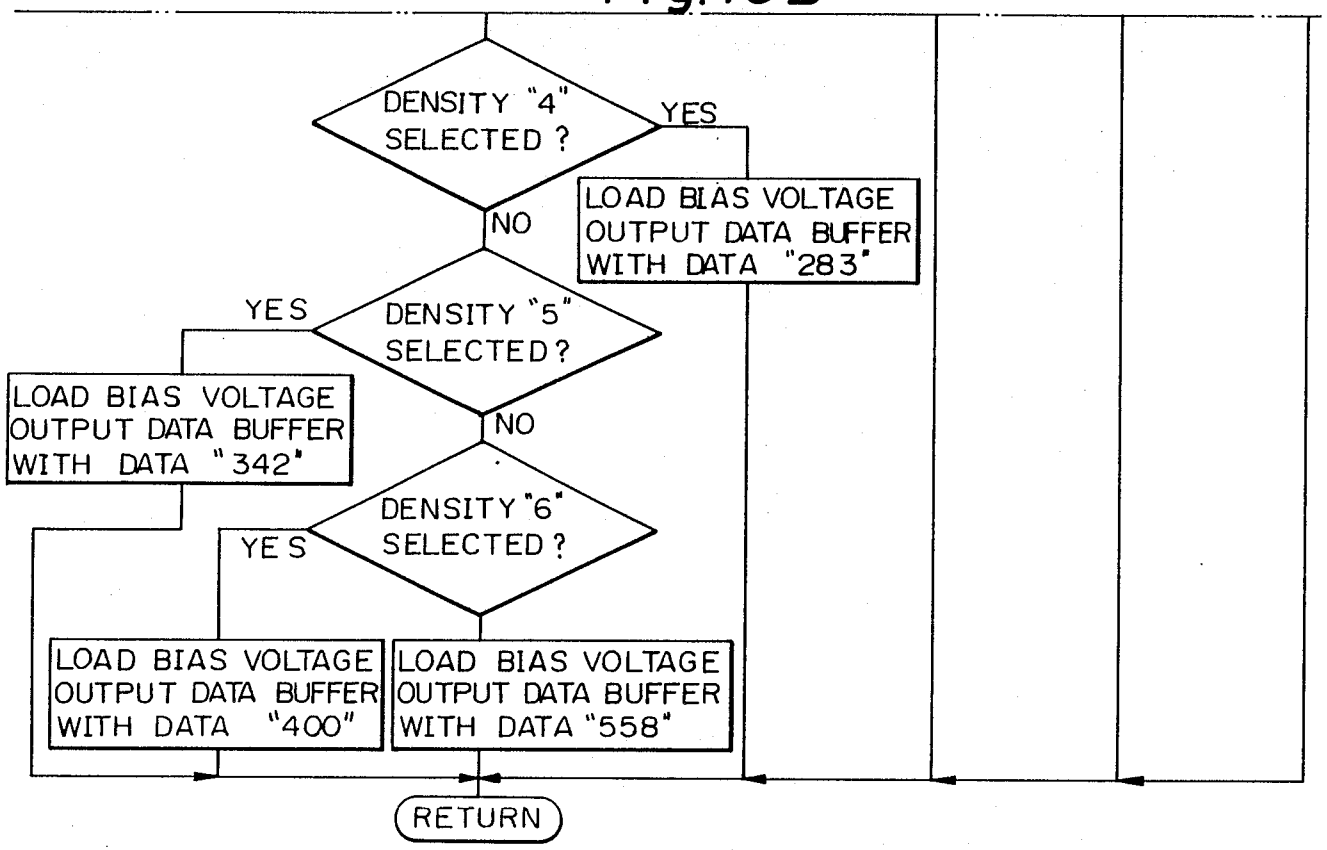

FIG. 10 shows a sequence of steps for loading the data buffer with data which is associated with a particular density as may be selected by the switch 38*a* or 38*b*.

Figure 11:
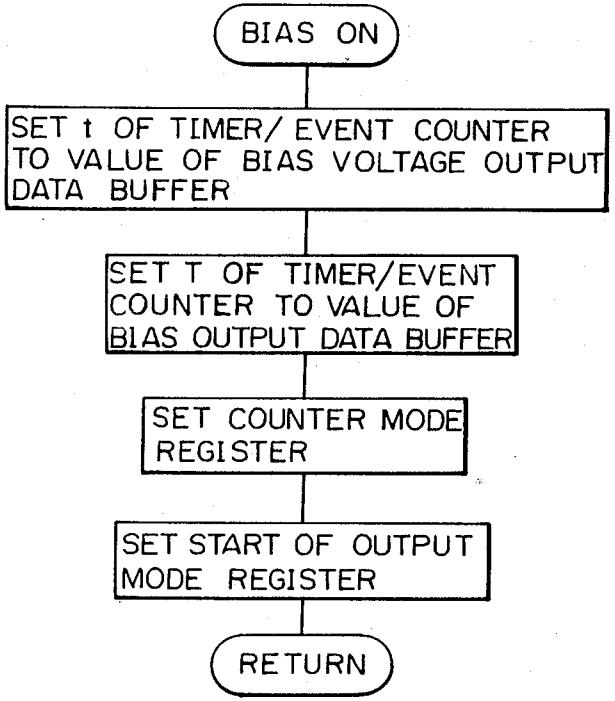

FIG. 11 is a flowchart demonstrating an operation which occurs in a bias ON condition. As shown, the pulse width t of the output of the timer/event counter is set to a value stored in the above-mentioned data buffer and the period T is set to "833" which is associated with 1 microsecond. Then, the timer/event counter is conditioned for a counter mode. Thereafter, the start of an output mode register is set to cause the event counter to output the signal St.

Figure 12:
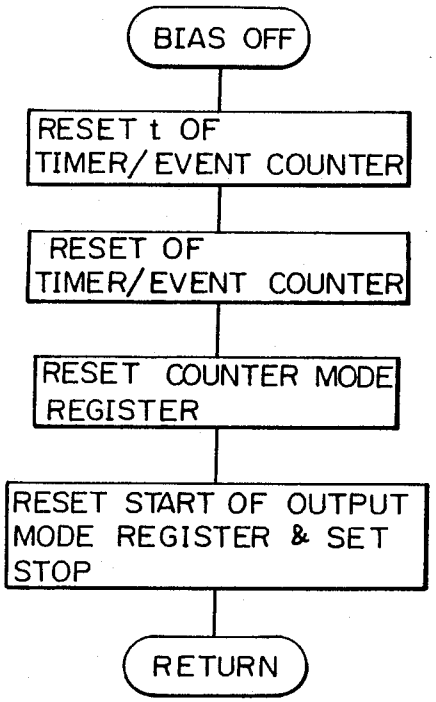

Further, FIG. 12 shows a flowchart associated with a bias OFF condition. As shown, the operation begins with resetting the pulse width t and period T of the output signal $S_t$ of the timer/event counter and resetting a counter mode register. Subsequently, the start of the output mode register is reset while, at the same time, the stop of that register is set to thereby interrupt the output of the bias voltage $V_o$.

In summary, in accordance with the present invention a plurality of desired bias voltages are attainable in a stable manner with a simple construction and without resorting to a complicated program.

Various modifications will become possible for those skilled in the art after receiving the teachings of the present disclosure without departing from the scope thereof.

What is claimed is:

1. A controller for an image forming apparatus for controlling a bias power source to vary the level of a bias voltage outputted by said bias power source in order to provide desired image density, said controller comprising:

density selecting means for selecting a desired image density;

trigger pulse generating means for generating a trigger pulse signal for triggering said bias power source so that bias power source outputs a bias voltage corresponding to said selected image density;

control means for controlling the pulse width of said trigger pulse signal so that the pulse width conforms to said selected image density; and means for causing said bias voltage to have a discharge time constant and means for providing a period of said trigger pulse signal which period is much smaller than said discharge time constant so that any ripples in said bias voltage which are ascribable to the modulation of said pulse width of said trigger pulse are substantially negligible.

2. A controller as claimed in claim 1, wherein said control means comprises a central processing unit (CPU).

3. A controller as claimed in claim 2, wherein said trigger pulse generating means comprises a timer/event counter which is built in said CPU.

* * * * *